US009249561B2

(12) United States Patent
Wu

(10) Patent No.: US 9,249,561 B2
(45) Date of Patent: Feb. 2, 2016

(54) ANTI-FREEZE FAUCET STRUCTURE

(71) Applicant: Cheng-Hsuan Wu, Lugang Township, Changhua County (TW)

(72) Inventor: Cheng-Hsuan Wu, Lugang Township, Changhua County (TW)

( * ) Notice: Subject to any disclaimer, the term of this patent is extended or adjusted under 35 U.S.C. 154(b) by 78 days.

(21) Appl. No.: 14/277,828

(22) Filed: May 15, 2014

(65) Prior Publication Data

US 2015/0330063 A1 Nov. 19, 2015

(51) Int. Cl.

| | |
|---|---|
| ***E03C 1/10*** | (2006.01) |
| ***E03B 9/02*** | (2006.01) |
| ***E03B 7/10*** | (2006.01) |
| ***E03B 9/14*** | (2006.01) |

(52) U.S. Cl.
CPC . *E03B 9/027* (2013.01); *E03B 7/10* (2013.01); *E03B 9/14* (2013.01)

(58) Field of Classification Search
CPC ..... E03B 9/027; E03B 7/10; E03B 9/14
USPC ..... 137/218
See application file for complete search history.

(56) References Cited

U.S. PATENT DOCUMENTS

| | | | | | |
|---|---|---|---|---|---|
| 2,952,270 | A * | 9/1960 | Fulton | E03B 7/10 | 137/360 |
| 5,158,105 | A * | 10/1992 | Conway | E03B 7/10 | 137/296 |
| 6,142,172 | A * | 11/2000 | Shuler | E03B 7/10 | 137/218 |
| 6,761,183 | B1 * | 7/2004 | Hoeptner, III | E03C 1/106 | 137/218 |
| 6,769,446 | B1 * | 8/2004 | Ball | E03B 7/10 | 137/301 |
| 7,654,280 | B2 * | 2/2010 | Wu | E03B 7/10 | 137/301 |
| 8,402,991 | B2 * | 3/2013 | Wu | E03B 7/12 | 137/301 |
| 8,613,290 | B1 * | 12/2013 | Wu | F16K 3/08 | 137/218 |
| 8,740,831 | B2 * | 6/2014 | Wu | A61F 13/38 | 206/209 |
| 2011/0114865 | A1 * | 5/2011 | Wu | F16K 3/08 | 251/321 |
| 2013/0312845 | A1 * | 11/2013 | Wu | E03B 9/027 | 137/218 |

* cited by examiner

*Primary Examiner* — Craig Schneider
*Assistant Examiner* — Kevin Barss
(74) *Attorney, Agent, or Firm* — Alan D. Kamrath; Kamrath IP Lawfirm, P.A.

(57) ABSTRACT

An anti-freeze faucet structure contains: an outer pipe, an inner pipe, a control valve, a resilient element, a unidirectional sealing gasket, and a controlling assembly. The outer pipe includes an inlet, an outlet, an opening, an intake valve, and a channel, wherein the channel has plural inner threads. The inner pipe includes a connecting segment and a fitting segment opposite to the connecting segment, the fitting segment has a peripheral protrusion, and the peripheral protrusion has a plurality of outer threads screwing with the plural inner threads of the outer pipe. The control valve movably is fitted on the fitting segment to abut against and close the inlet; the resilient element is fixed in the inner pipe to push against the control valve; the unidirectional sealing gasket is fitted onto the inner pipe; and the controlling assembly is disposed on the opening of the outer pipe.

8 Claims, 12 Drawing Sheets

ANTI-FREEZE FAUCET STRUCTURE

BACKGROUND OF THE INVENTION

1. Field of the Invention

The present invention relates to a faucet structure, and more particularly to an anti-freeze faucet structure which has excellent check effect and is operated easily and quickly.

2. Description of the Prior Art

A conventional anti-freeze faucet is employed to supply water at a frozen temperature. To avoid sewage sucking to water pipe fitting from the anti-freeze faucet by using vacuum siphon effect, a check structure is arranged in the anti-freeze faucet. As shown in FIG. 12, the conventional anti-freeze faucet contains an outer pipe 100, an inner pipe 200, a closing assembly 300, and a unidirectional sealing gasket 400, wherein the outer pipe 100 includes a first orifice 110 defined on a first end thereof and connecting with a water pipe fitting, an outlet connector 120 disposed on a second end thereof, and a channel 130 communicating with the first orifice 110 and the outlet connector 120. The inner pipe 200 is inserted into the outer pipe 100 and includes a first end extending out of the outer pipe 100 to couple with a control device 210 and a second end joining with a fitting sleeve 200. The closing assembly 300 is movably fitted with the fitting sleeve 220 of the inner pipe 200, and the control device 210 controls the inner pipe 200 to move to turn on/off water. Moreover, the unidirectional sealing gasket 400 is fitted on the closing assembly 300 to limit the water flowing through the channel 130 unidirectionally.

The conventional anti-freeze faucet generates a reverse suction in vacuum siphon effect to stop the water flowing back to the water pipe fitting from the outlet connector 120 of the outer pipe 100 by ways of the unidirectional sealing gasket 400, when the water in the water pipe fitting does not flow. Furthermore, the closing assembly 300 is driven by a suction force to close the first orifice 110 of the outer pipe 100, thus forming a check effect. However, the closing assembly 300 cannot close the first orifice 110 of the outer pipe 100 by using unstable vacuum suction completely, so sewage flows back to the water pipe fitting from the anti-freeze faucet, and the control device 210 of the inner pipe 200 screws with the outer pie 100, so the control device 210 drives the inner pipe 200 to rotate unstably, and then the closing assembly 300 fitting with the fitting sleeve 220 of the inner pipe 200 offsets easily, the first orifice 110 of the outer pipe 100 cannot be completely closed by the closing assembly 300, thereby leaking the water easily when the anti-freeze faucet is turned off.

The present invention has arisen to mitigate and/or obviate the afore-described disadvantages.

SUMMARY OF THE INVENTION

The primary objective of the present invention is to provide an anti-freeze faucet structure which contains a resilient element fixed in an inner pipe adjacent to a fitting segment to push a control valve to close an inlet of an outer pipe automatically, thus obtaining a check effect.

Another objective of the present invention is to provide an anti-freeze faucet structure which contains a connecting segment of the inner pipe extending out of an opening of the outer pipe to connect with a controlling assembly, and a plurality of outer threads of a peripheral protrusion screw with plural inner threads of the outer pipe, so the inner pipe moves quickly and stably, the control valve closes the inlet of the outer pipe tightly, thus preventing water leakage from the inlet.

To obtain the above objectives, an anti-freeze faucet structure provided by the present invention contains: an outer pipe, an inner pipe, a control valve, a resilient element, a unidirectional sealing gasket, and a controlling assembly.

The outer pipe includes an inlet defined on a first end thereof to connect with a water pipe fitting, an outlet formed on a second end thereof, an opening arranged on the second end thereof adjacent to the outlet, an intake valve disposed on the second end thereof opposite to the opening, and a channel defined in the second end thereof and communicating with the inlet, the outlet, the opening and the intake valve, wherein the channel has plural inner threads proximate to the inlet.

The inner pipe is inserted into the outer pipe and includes a connecting segment and a fitting segment opposite to the connecting segment, wherein the connecting segment extends out of the opening of the outer pipe, the fitting segment has a peripheral protrusion arranged around an outer rim thereof, and the peripheral protrusion has a plurality of outer threads formed thereon and plural flow slots defined thereon and screwing with the plural inner threads of the outer pipe.

The control valve movably is fitted on the fitting segment of the inner pipe to abut against and close the inlet of the outer pipe.

The resilient element is fixed in the inner pipe adjacent to the fitting segment to push against the control valve.

The unidirectional sealing gasket is fitted onto the inner pipe close to the fitting segment to limit water unidirectionally flows through the channel.

The controlling assembly is disposed on the opening of the outer pipe and connecting with and driving the inner pipe to rotate, thus turning on/off the water.

DETAILED DESCRIPTION OF THE PREFERRED EMBODIMENTS

Figure 1:
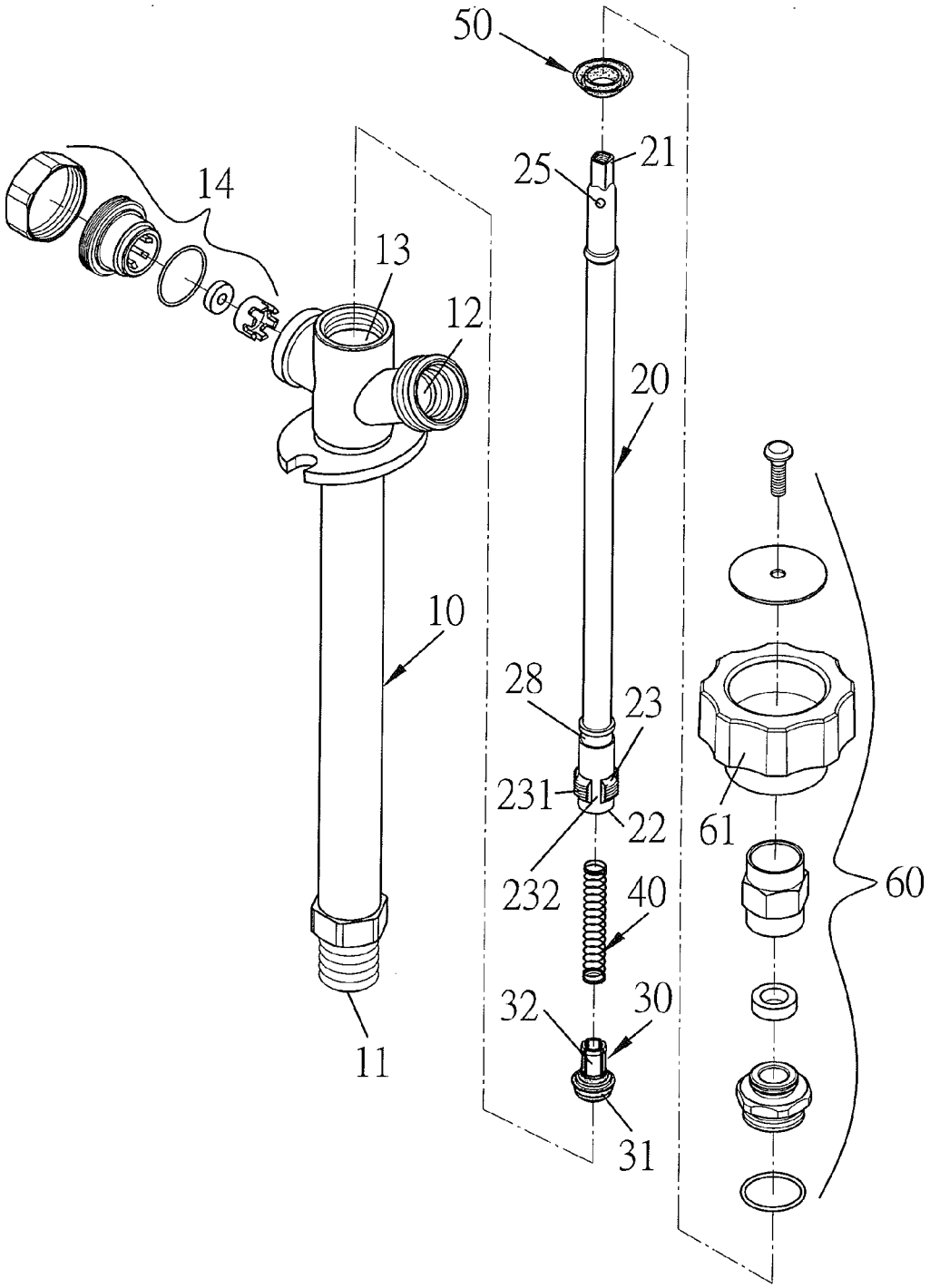
FIG. 1 is a perspective view showing the exploded components of an anti-freeze faucet structure according to a preferred embodiment of the present invention.
Figure 2:
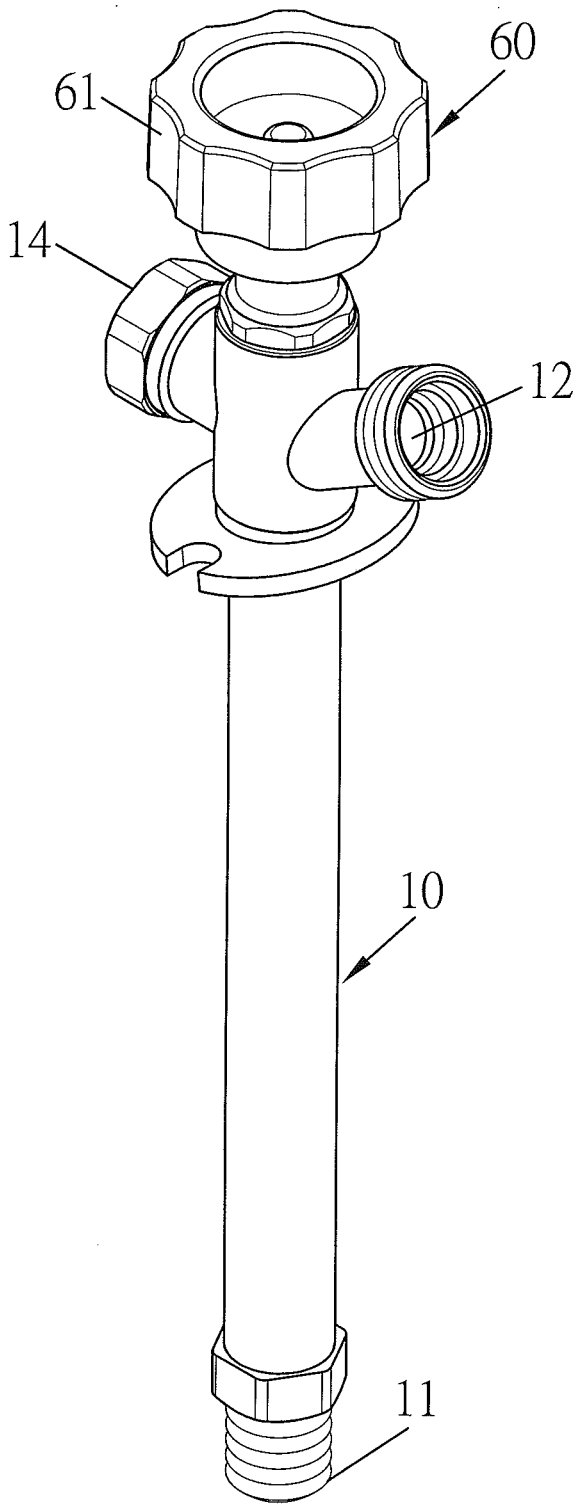
FIG. 2 is a perspective view showing the assembly of the anti-freeze faucet structure according to the preferred embodiment of the present invention.
Figure 3:
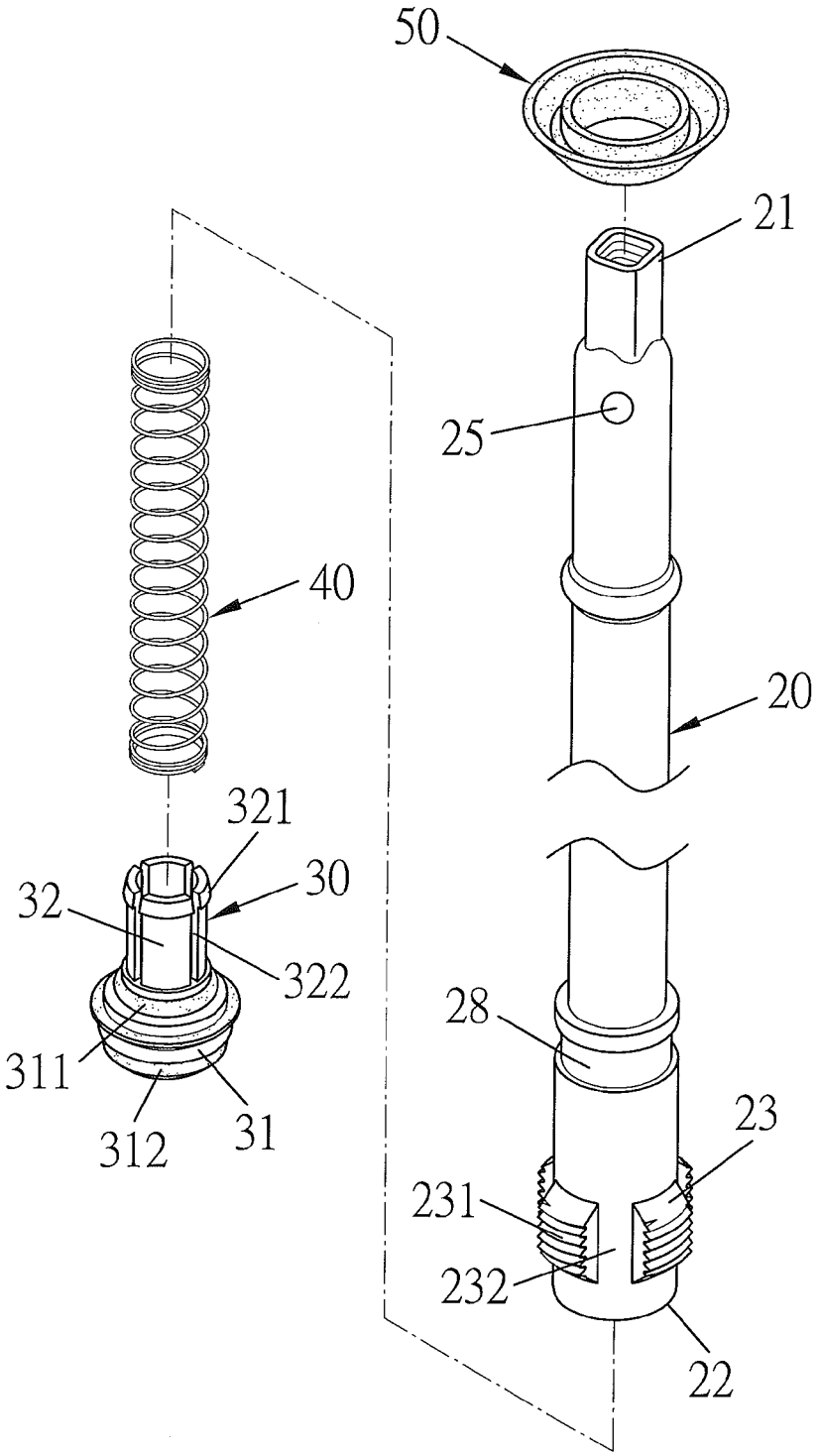
FIG. 3 is a perspective view showing the exploded components of a part of the anti-freeze faucet structure according to the preferred embodiment of the present invention.
Figure 4:
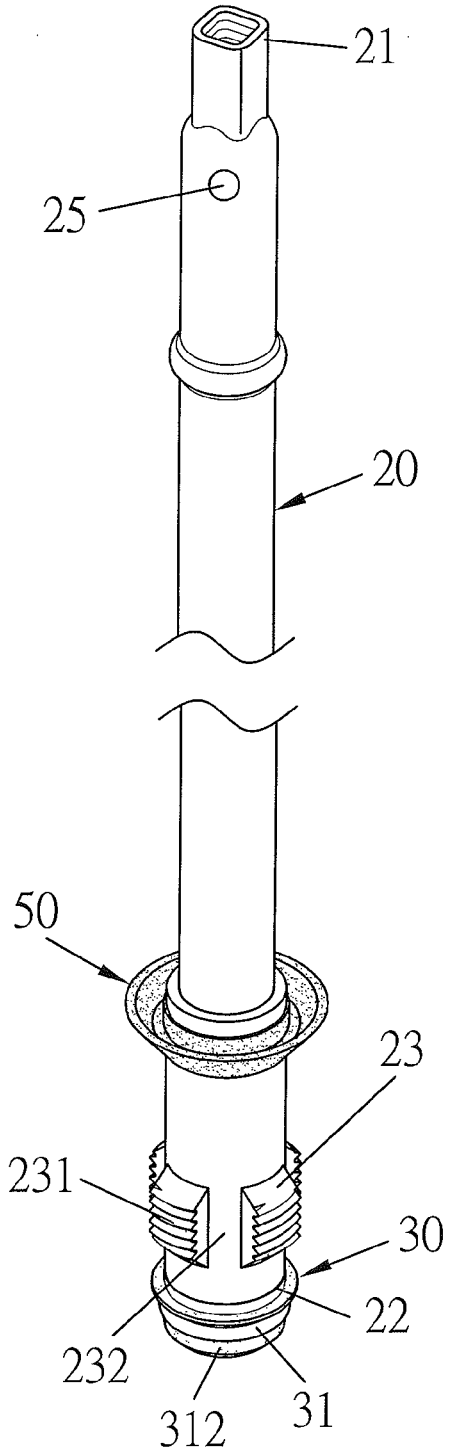
FIG. 4 is a perspective view showing the assembly of a part of the anti-freeze faucet structure according to the preferred embodiment of the present invention.
Figure 5:
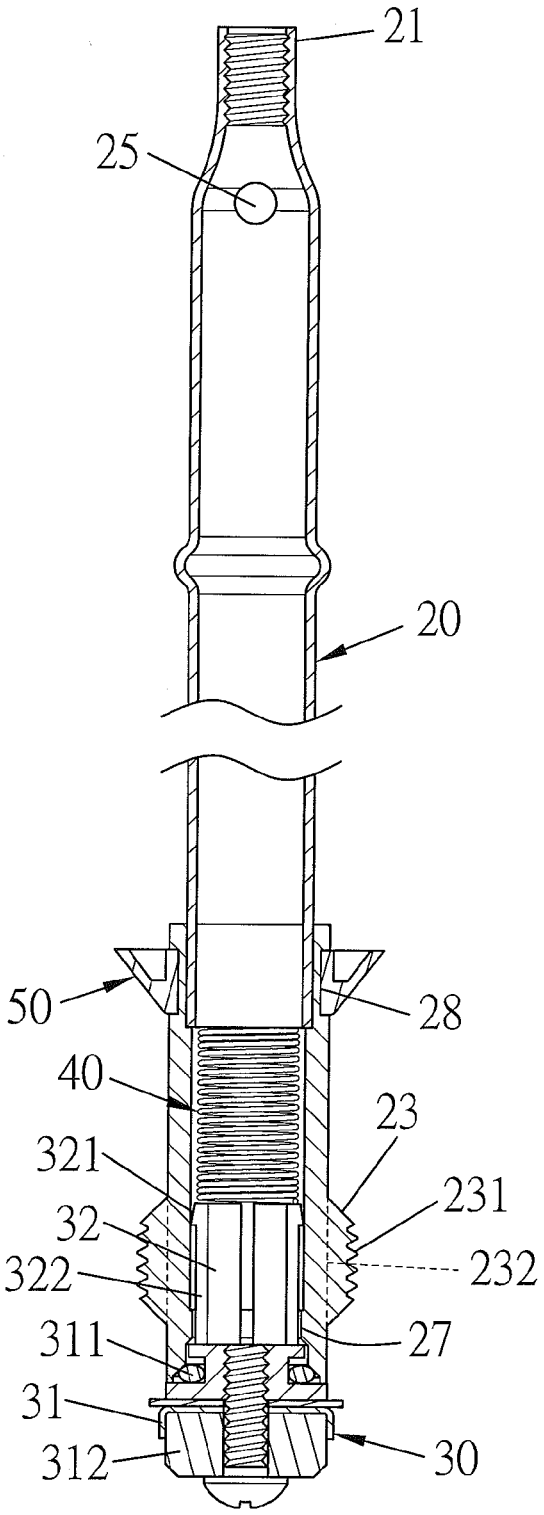
FIG. 5 is a cross sectional view showing the assembly of a part of the anti-freeze faucet structure according to the preferred embodiment of the present invention.
Figure 6:
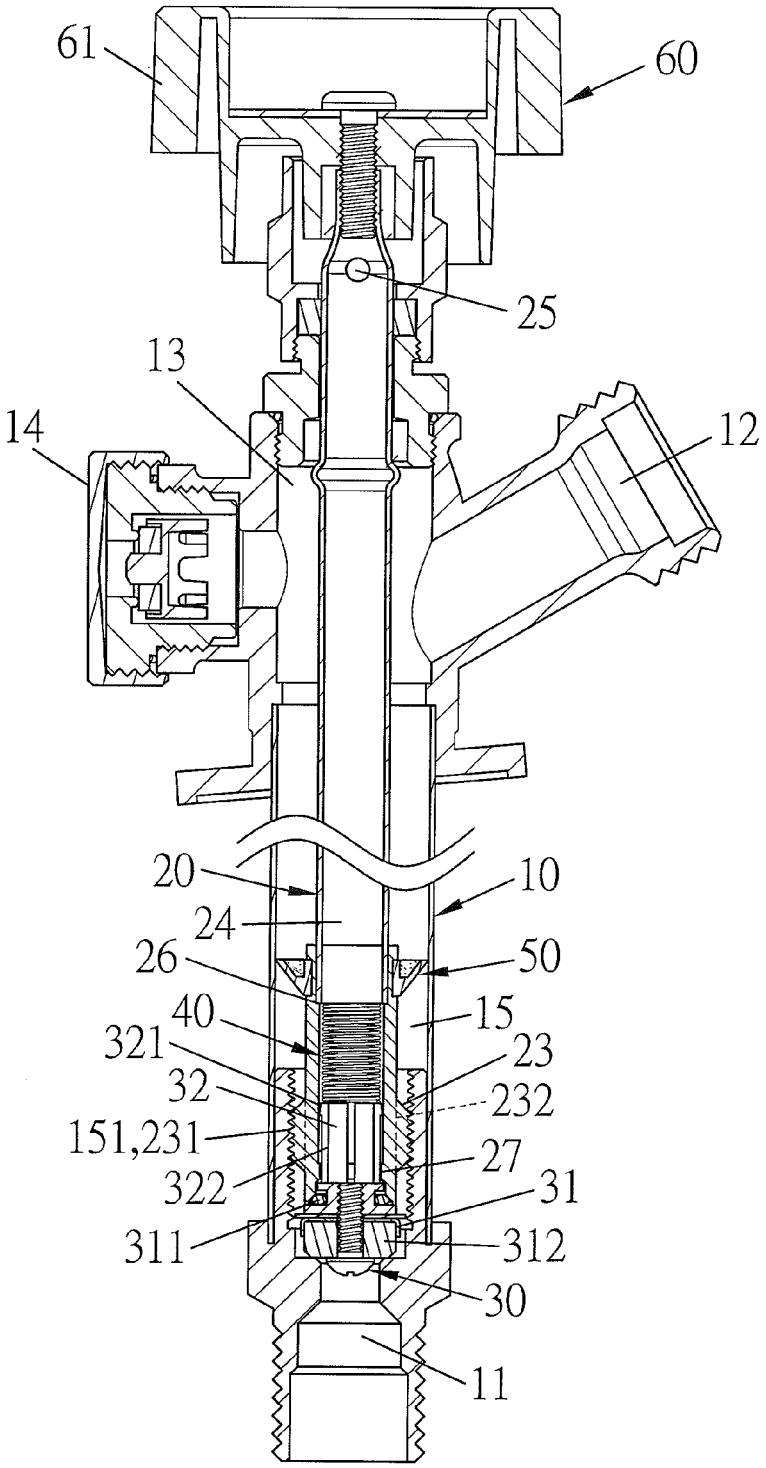
FIG. 6 is a cross sectional view showing the assembly of the anti-freeze faucet structure according to the preferred embodiment of the present invention.
Figure 7:
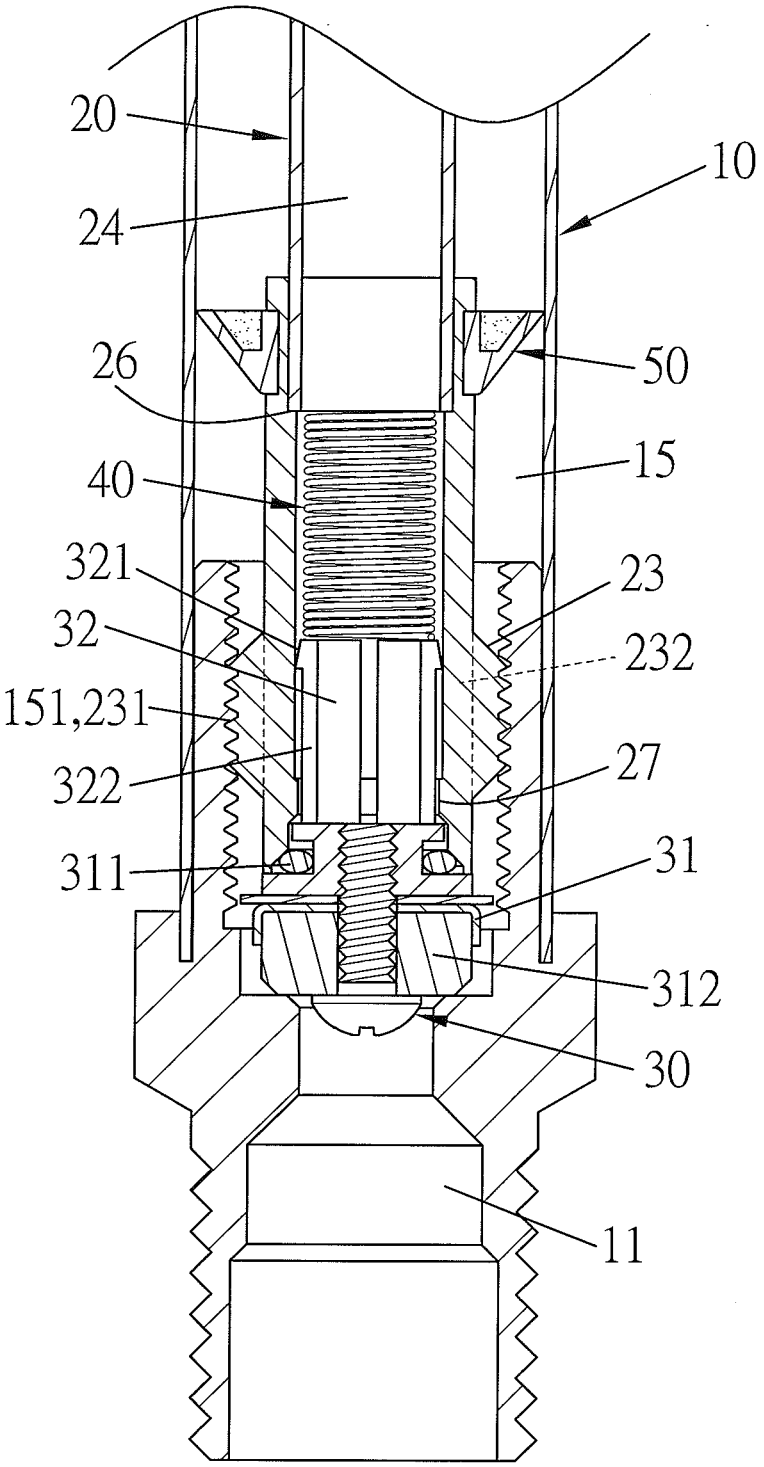
FIG. 7 is an amplified cross sectional view showing a part of FIG. 6.

The present invention will be clearer from the following description when viewed together with the accompanying drawings, which show, for purpose of illustrations only, a first embodiment in accordance with the present invention.

With reference to FIGS. 1-7, an anti-freeze faucet structure according to a preferred embodiment of the present invention comprises an outer pipe 10, an inner pipe 20, a control valve 30, a resilient element 40, a unidirectional sealing gasket 50, and a controlling assembly 60.

The outer pipe 10 includes an inlet 11 defined on a first end thereof to connect with a water pipe fitting, an outlet 12 formed on a second end thereof, an opening 13 arranged on the second end thereof adjacent to the outlet 12, an intake valve 14 disposed on the second end thereof opposite to the opening 13, and a channel 15 defined in the second end thereof and communicating with the inlet 11, the outlet 12, the opening 13 and the intake valve 14, wherein the channel 15 has plural inner threads 151 proximate to the inlet 11.

The inner pipe 20 is inserted into the outer pipe 10 and includes a connecting segment 21 and a fitting segment 22 opposite to the connecting segment 21, wherein the connecting segment 21 extends out of the opening 13 of the outer pipe 10, the fitting segment 22 has a peripheral protrusion 23 arranged around an outer rim thereof, and the peripheral protrusion 23 has a plurality of outer threads 231 formed thereon and plural flow slots 232 defined thereon and screwing with the plural inner threads 151 of the outer pipe 10. The inner pipe 20 also includes an air tunnel 24 arranged therein and a ventilation orifice 25 defined on an outer wall thereof adjacent to the connecting segment 21 and communicating with the air tunnel 24, wherein the ventilation orifice 25 extends out of the opening 13 of the outer pipe 10 with the connecting segment 21, and the inner pipe 20 further includes a shoulder 26 formed proximate to an inner rim of the fitting segment 22 thereof, a locking flange 27 mounted between the shoulder 26 and the fitting segment 22, and a peripheral groove 28 arranged around the outer wall thereof adjacent to the fitting segment 22.

The control valve 30 includes a plugging disc 31 and an extending tube 32, a diameter of which is smaller than that of the plugging disc 31, wherein a diameter of the plugging disc 31 is greater than that of inner pipe 20, the plugging disc 31 has an O ring 311 fitted on a first end thereof proximate to the extending tube 32 and a seal washer 312 fitted on a second end thereof away from the extending tube 32; the extending tube 32 has a lock hook 321 mounted on a first end thereof away from the plugging disc 31 and plural slits 322 extending from the first end thereof away from the plugging disc 31 to a second end thereof close to the plugging disc 31, such that the extending tube 32 flexibly retracts and expands and is inserted into the fitting segment 22 of the inner pipe 20, the lock hook 321 of the extending tube 32 is forced to insert through the locking flange 27 of the fitting segment 22 of the inner pipe 20 to be limited by the locking flange 27, so a movement range of the extending tube 32 is limited.

In this embodiment, the resilient element 40 is a spring fixed between the shoulder 26 of the fitting segment 22 and the extending tube 32 of the control valve 30, hence the resilient element 40 pushes the control valve 30 to the inlet 11 of the outer pipe 10.

The unidirectional sealing gasket 50 is fitted onto the inner pipe 20 close to the peripheral groove 28 of the fitting segment 22 and abuts against an inner wall of the outer pipe 10 to limit water unidirectionally flows through the channel 15 of the outer pipe 10.

The controlling assembly 60 is disposed on the opening 13 of the outer pipe 10 and includes a rotary knob 61 for connecting with the connecting segment 21 of the inner pipe 20 and for driving the inner pipe 20 to rotate.

When an anti-freeze faucet is turned off to stop the water, the rotary knob 61 of the controlling assembly 60 is rotated to drive the inner pipe 20, the inner pipe 20 rotates and the plurality of outer threads 231 of the peripheral protrusion 23 screw with the plural inner threads 151 of the outer pipe 10, thereafter the inner pipe 20 moves toward the inlet 11 of the outer pipe 10, such that the seal washer 312 of the plugging disc 31 of the control valve 30 closes the outlet 11 of the outer pipe 10, and the fitting segment 22 of the inner pipe 20 is biased against the O ring 311 of the plugging disc 31 of the control valve 30 to shut down the water, thereafter the extending tube 32 of the control valve 30 completely inserts into the air tunnel 24 of the inner pipe 20 to press the resilient element 40.

Figure 8:
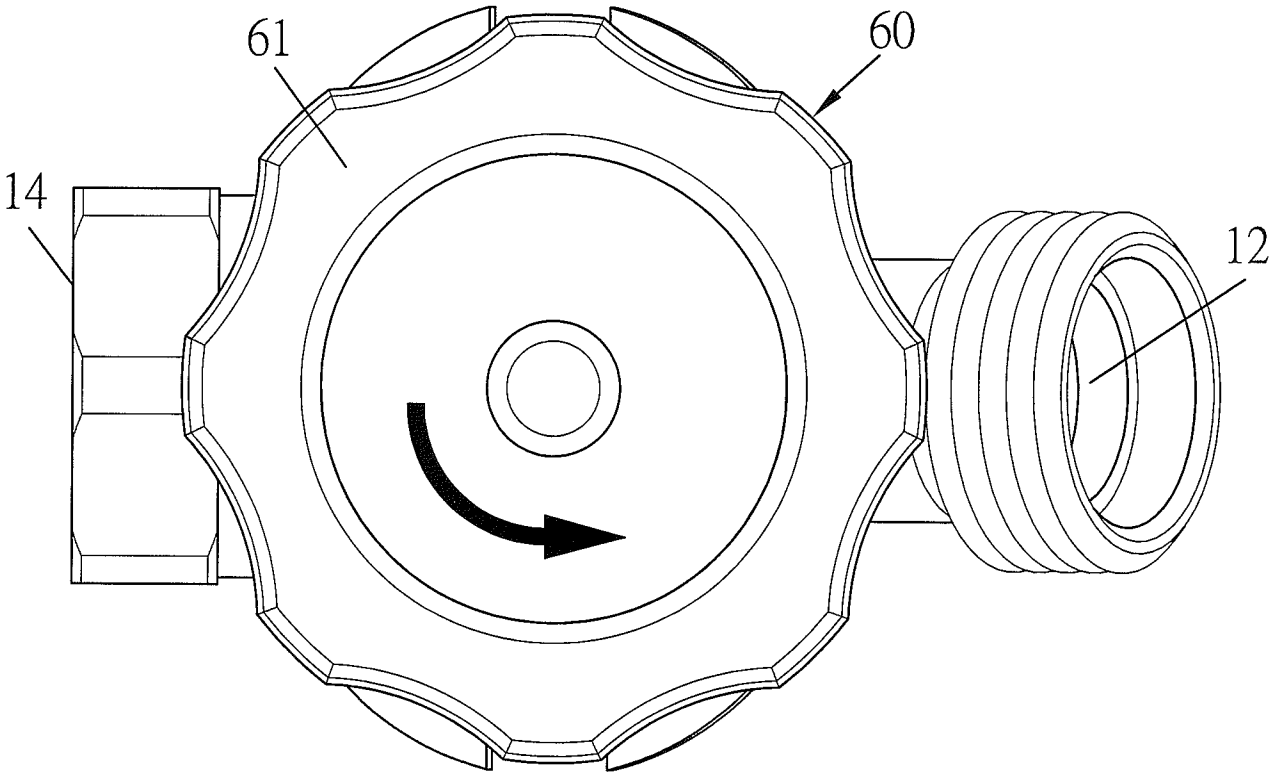
FIG. 8 is a plan view showing the operation of the anti-freeze faucet structure according to the preferred embodiment of the present invention.
Figure 9:
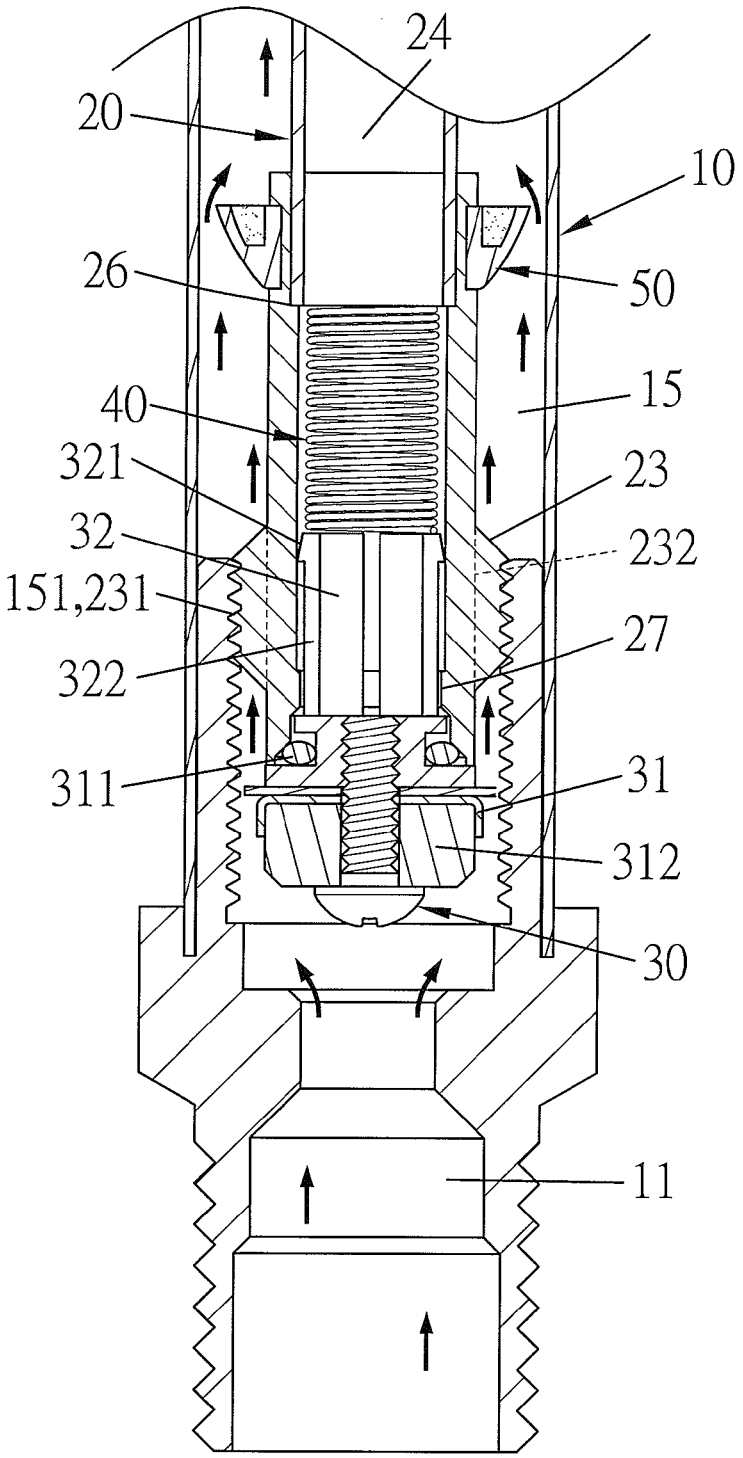
FIG. 9 is a cross sectional view showing the operation of the anti-freeze faucet structure according to the preferred embodiment of the present invention.

Referring to FIGS. 8 and 9, when the anti-freeze faucet is turned on to start the water, the rotary knob 61 of the controlling assembly 60 is rotated reversely to drive the inner pipe 20 to rotate, and the plurality of outer threads 231 of the peripheral protrusion 23 screw with the plural inner threads 151 of the outer pipe 10, the inner pipe 20 is driven to move toward the opening 13 of the outer pipe 10, such that the fitting segment 22 of the inner pipe 20 is not biased against the O ring 311 of the plugging disc 31 of the control valve 30, the resilient element 40 expends, and the water pressure in the supply pipe fitting pushes against the control valve 30 via the inlet 11 of the outer pipe 10, hence the seal washer 312 of the plugging disc 31 of the control valve 30 removes from the outlet 11 of the outer pipe 10, and the resilient element 40 is pressed again, thereafter the water flows out of the outlet 12 of the outer pipe 10 through the channel 15 of the outer pipe 10, the plural flow slots 232 of the inner pipe 20, and the unidirectional sealing gasket 50.

Figure 10:
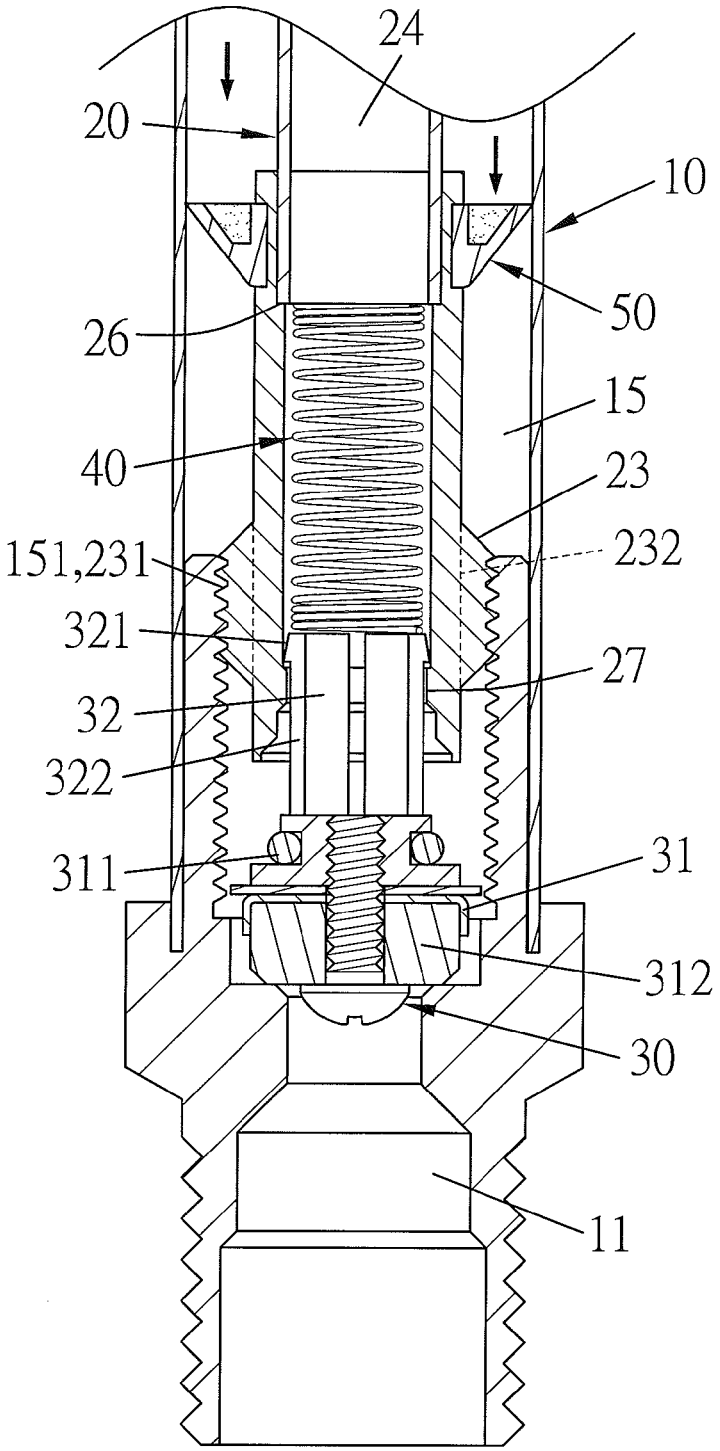
FIG. 10 is another cross sectional view showing the operation of the anti-freeze faucet structure according to the preferred embodiment of the present invention.

When the anti-freeze faucet is turned on and the water is stopped in the supply pipe fitting as shown in FIG. 10, the resilient element 40 pushed the control valve 30 toward the inlet 11 of the outer pipe 10 so that the seal washer 312 of the plugging disc 31 of the control valve 30 automatically closes the outlet 11 of the outer pipe 10, and the unidirectional sealing gasket 50 provides a check effect to stop sewage flowing back to the supply pipe fitting from the anti-freeze faucet.

Figure 11:
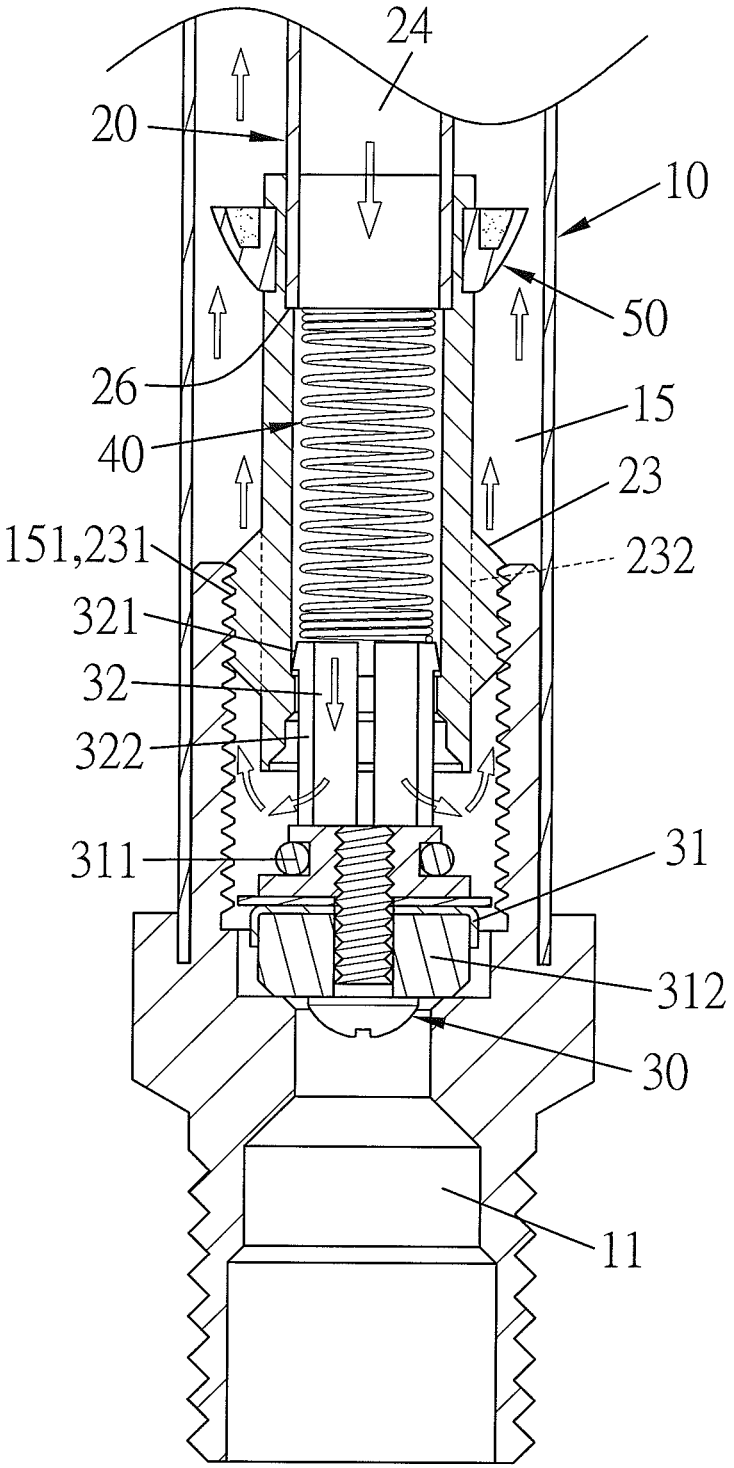
FIG. 11 is also another cross sectional view showing the operation of the anti-freeze faucet structure according to the preferred embodiment of the present invention.
Figure 12:
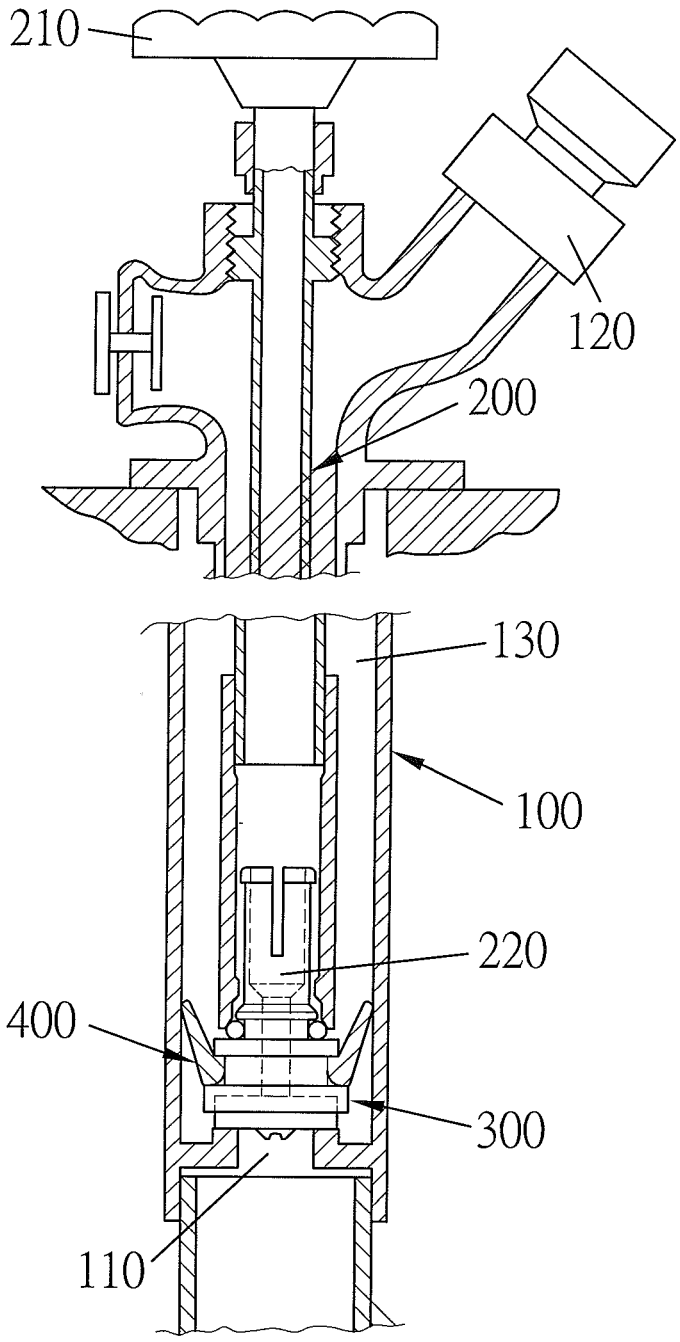
FIG. 12 Prior Art
FIG. 12 is a cross sectional view of a conventional anti-freeze faucet structure.

When the anti-freeze faucet is turned on but the water cannot flow in the supply pipe fitting, as illustrated in FIG. 11, the resilient element 40 pushes the control valve 30 toward the inlet 11 of the outer pipe 10 so that the seal washer 312 of the plugging disc 31 of the control valve 30 automatically closes the outlet 11 of the outer pipe 10, and the extending tube 32 of the control valve 30 extends out of the inner pipe 20 so that external air flows into the channel 15 of the outer pipe 10 from the ventilation orifice 25 of the inner pipe 20 via the air tunnel 24 and the plural slits 322 of the extending tube 32 of the control valve 30, an air inflow effect produces in the intake valve 14 of the outer pipe 10 to obtain a vacuum breaking effect, hence the water in the inlet 11 of the outer pipe 10 discharges out of the outlet 12.

Thereby, the anti-freeze faucet structure of the present invention has advantages as follows:

1. The resilient element 40 is fixed close to the fitting segment 22 of the inner pipe 20, so when the water cannot flow in the supply pipe fitting, the resilient element 40 automatically pushes the control valve 30 to close the outlet 11 of the outer pipe 10, and the unidirectional sealing gasket 50 provides the check effect to avoid the sewage flowing back to the supply pipe fitting from the anti-freeze faucet.

2. The connecting segment 21 of the inner pipe 20 extends out of the opening 13 of the outer pipe 10 to couple with the controlling assembly 60, and the plurality of outer threads 231 of the peripheral protrusion 23 screw with the plural inner threads 151 of the outer pipe 10, so when the rotary knob 61 of the controlling assembly 60 is rotated, the inner pipe 20 moves quickly and stably, and the control valve 30 connected with the fitting segment 22 does not offset to close the inlet 11 of the outer pipe 10 tightly, thus preventing water leakage from the inlet 11.

While various embodiments in accordance with the present invention have been shown and described, it is clear to those skilled in the art that further embodiments may be made without departing from the scope of the present invention.

What is claimed is:

1. An anti-freeze faucet structure comprising:

an outer pipe including an inlet defined on a first end thereof to connect with a water pipe fitting, an outlet formed on a second end thereof, an opening arranged on the second end thereof adjacent to the outlet, an intake valve disposed on the second end thereof opposite to the opening, and a channel defined in the second end thereof and communicating with the inlet, the outlet, the opening and the intake valve, wherein the channel has plural inner threads proximate to the inlet;

an inner pipe inserted into the outer pipe and including a connecting segment and a fitting segment opposite to the connecting segment, wherein the connecting segment extends out of the opening of the outer pipe, the fitting segment has a peripheral protrusion arranged around an outer rim thereof, and the peripheral protrusion has a plurality of outer threads formed thereon and plural flow slots defined thereon and screwing with the plural inner threads of the outer pipe;

a control valve movably fitted on the fitting segment of the inner pipe to abut against and close the inlet of the outer pipe;

a resilient element fixed in the inner pipe adjacent to the fitting segment to push against the control valve;

a unidirectional sealing gasket fitted onto the inner pipe close to the fitting segment to limit water unidirectionally flows through the channel;

a controlling assembly disposed on the opening of the outer pipe and connecting with and driving the inner pipe to rotate, thus turning on/off the water.

2. The anti-freeze faucet structure as claimed in claim 1, wherein the inner pipe also includes an air tunnel arranged therein and a ventilation orifice defined on an outer wall thereof adjacent to the connecting segment and communicating with the air tunnel, and the ventilation orifice extends out of the opening of the outer pipe with the connecting segment.

3. The anti-freeze faucet structure as claimed in claim 1, wherein the inner pipe further includes a shoulder formed proximate to an inner rim of the fitting segment thereof and a locking flange mounted between the shoulder and the fitting segment, the control valve includes a plugging disc and an extending tube, a diameter of the extending tube is smaller than that of the plugging disc, the extending tube has a lock hook mounted on a first end thereof away from the plugging disc and plural slits extending from the first end thereof away from the plugging disc to a second end thereof close to the plugging disc, such that the extending tube flexibly retracts and expands and is inserted into the extending tube of the inner pipe, the lock hook of the extending tube is limited by the locking flange of the extending tube of the inner pipe, so a movement range of the extending tube is limited.

4. The anti-freeze faucet structure as claimed in claim 1, wherein the inner pipe includes a peripheral groove arranged around the outer wall thereof adjacent to the fitting segment to fit with the unidirectional sealing gasket.

5. The anti-freeze faucet structure as claimed in claim 1, wherein a diameter of the plugging disc is greater than that of inner pipe, the plugging disc has an O ring fitted on a first end thereof proximate to the extending tube and a seal washer fitted on a second end thereof away from the extending tube.

6. The anti-freeze faucet structure as claimed in claim 1, wherein the resilient element is a spring.

7. The anti-freeze faucet structure as claimed in claim 3, wherein the resilient element is fixed between the shoulder of the fitting segment of the inner pipe and the control valve, hence the resilient element pushes the control valve to the inlet of the outer pipe.

8. The anti-freeze faucet structure as claimed in claim 3, wherein the controlling assembly includes a rotary knob for connecting with the connecting segment of the inner pipe and for driving the inner pipe to rotate.

* * * * *